US010844659B2

(12) United States Patent
Duffy

(10) Patent No.: US 10,844,659 B2
(45) Date of Patent: Nov. 24, 2020

(54) AUTOMATIC OPERATION OF BUILDING WINDOW USING MAGNETIC FIELDS

(71) Applicant: John Duffy, Green Bay, WI (US)

(72) Inventor: John Duffy, Green Bay, WI (US)

( * ) Notice: Subject to any disclaimer, the term of this patent is extended or adjusted under 35 U.S.C. 154(b) by 161 days.

(21) Appl. No.: 15/648,973

(22) Filed: Jul. 13, 2017

(65) Prior Publication Data

US 2019/0017319 A1 Jan. 17, 2019

(51) Int. Cl.

| | |
|---|---|
| ***E05B 47/00*** | (2006.01) |
| ***E06B 9/52*** | (2006.01) |
| ***E05F 15/60*** | (2015.01) |

(52) U.S. Cl.

CPC ..... *E06B 9/52* (2013.01); *E05B 47/0004* (2013.01); *E05F 15/60* (2015.01); *E05B 2047/0068* (2013.01); *E05Y 2201/462* (2013.01); *E05Y 2800/75* (2013.01); *E05Y 2900/148* (2013.01); *E06B 2009/524* (2013.01); *E06B 2009/528* (2013.01)

(58) Field of Classification Search

CPC ..... E06B 2009/2646; E06B 9/52; E06B 2009/528; E06B 2009/524; E05B 47/0004; E05B 2047/0068; E05F 15/60; E05Y 2800/75; E05Y 2201/462; E05Y 2900/148; E05Y 2900/00; E05Y 2900/15; E05Y 2900/152; E05Y 2900/154

USPC ..... 160/84.02

See application file for complete search history.

(56) References Cited

U.S. PATENT DOCUMENTS

| | | | | |
|---|---|---|---|---|
| 1,022,870 A * | 4/1912 | Power | E06B 7/26 | 454/218 |
| 2,261,941 A * | 11/1941 | Persson | E06B 9/521 | 160/84.04 |
| 2,270,202 A * | 1/1942 | Persson | E06B 9/54 | 160/40 |
| 2,311,413 A * | 2/1943 | Persson | E06B 9/54 | 160/20 |
| 2,925,769 A * | 2/1960 | Kubatzky | E06B 7/06 | 454/225 |

(Continued)

FOREIGN PATENT DOCUMENTS

| | | |
|---|---|---|
| DE | 4433841 A1 | 2/1995 |
| EP | 2532825 A2 | 12/2012 |

(Continued)

OTHER PUBLICATIONS

International Searching Authority, "International Search Report and Written Opinion", dated Oct. 1, 2018, 7 pages.

*Primary Examiner* — Daniel P Cahn

(74) *Attorney, Agent, or Firm* — Merchant & Gould P.C.

(57) ABSTRACT

An apparatus and method for moving a window sash relative to a window frame. A window comprises a frame and a sash pivotally connected to the frame. A plurality of members are positioned between the sash and the frame, and the plurality of members are arranged in a series. A plurality of magnet sets comprise at least a first magnet operably connected to one member in the series of members and at least a second magnet operably connected to another member in the series of members. The first magnet is adjacent the second magnet, and at least one of the first or second magnets is an electromagnet. Energizing the electromagnets causes the members in the series of members to move relative to each other and causes the sash to move relative to the frame.

11 Claims, 5 Drawing Sheets

(56) References Cited

U.S. PATENT DOCUMENTS

| | | | | | |
|---|---|---|---|---|---|
| 3,384,147 | A | | 5/1968 | Smith | |
| 3,524,281 | A | | 8/1970 | Streeter, Jr. | |
| 4,395,939 | A | * | 8/1983 | Hough | B60H 1/262 160/92 |
| 4,969,291 | A | * | 11/1990 | Camara | E06B 3/38 160/97 |
| 5,357,712 | A | | 10/1994 | Streeter | |
| 5,694,996 | A | * | 12/1997 | Vigenberg | E04D 13/033 160/84.04 |
| 5,718,274 | A | | 2/1998 | Streeter | |
| 7,788,864 | B2 | * | 9/2010 | Jacobsen | E04D 13/033 52/204.5 |
| 8,176,962 | B2 | * | 5/2012 | Kilfoyle | E06B 7/32 160/180 |
| 2006/0150520 | A1 | * | 7/2006 | Hamazaki | E05B 65/08 49/449 |
| 2015/0041076 | A1 | | 2/2015 | Andre de la Porte | |
| 2017/0275944 | A1 | * | 9/2017 | LaPlaca | E06B 7/03 |

FOREIGN PATENT DOCUMENTS

| | | | |
|---|---|---|---|
| EP | 2631413 | A1 | 8/2013 |
| EP | 2679761 | A1 | 1/2014 |
| JP | H08191731 | A | 7/1996 |
| JP | H11225877 | A | 8/1999 |
| WO | 9534739 | A1 | 12/1995 |

* cited by examiner

AUTOMATIC OPERATION OF BUILDING WINDOW USING MAGNETIC FIELDS

TECHNICAL FIELD

This patent document relates to windows and more particularly to automatic operation of a building window using magnetic fields.

BACKGROUND

A common type of window installed in building are windows that have a pivoting sash. These windows are sometimes used as a primary window and place within reach of people who might open or closes them. Other times, they are place high on a wall above a non-opening window or toward the floor below such a window. In these arrangements, the windows are commonly used to ventilation, but may be inconvenient or even difficult for a person to reach. Whether it is a convenience or a necessary function, it is desirable to automate operation of such windows.

SUMMARY

One aspect of this patent document is an apparatus for moving a window sash relative to a window frame. The apparatus comprises a window, which in turn comprises comprising a frame and a sash pivotally connected to the frame. A plurality of members are positioned between the sash and the frame, and the plurality of members are arranged in a series. The apparatus further comprises a plurality of magnet sets. Each magnet set comprises at least a first magnet operably connected to one member in the series of members and at least a second magnet operably connected to another member in the series of members. The first magnet is adjacent to the second magnet, and at least one of the first or second magnets is an electromagnet. Energizing the electromagnets causes the members in the series of members to move relative to each other and causes the sash to move relative to the frame.

Another aspect of this patent document is a method for moving a window sash pivotally connected to a window frame, wherein a plurality of magnet sets are positioned between the sash and the frame in an accordion arrangement, and each magnet set has at least a first and at least a second magnet. The method comprises conducting an electrical current though the first magnet, the electrical current generating a magnetic field; moving at the second magnet relative to the first magnet; and pivoting the sash relative to the frame in response to moving the second magnet in response to the magnetic field generated by the first magnet.

DETAILED DESCRIPTION

Figure 1:
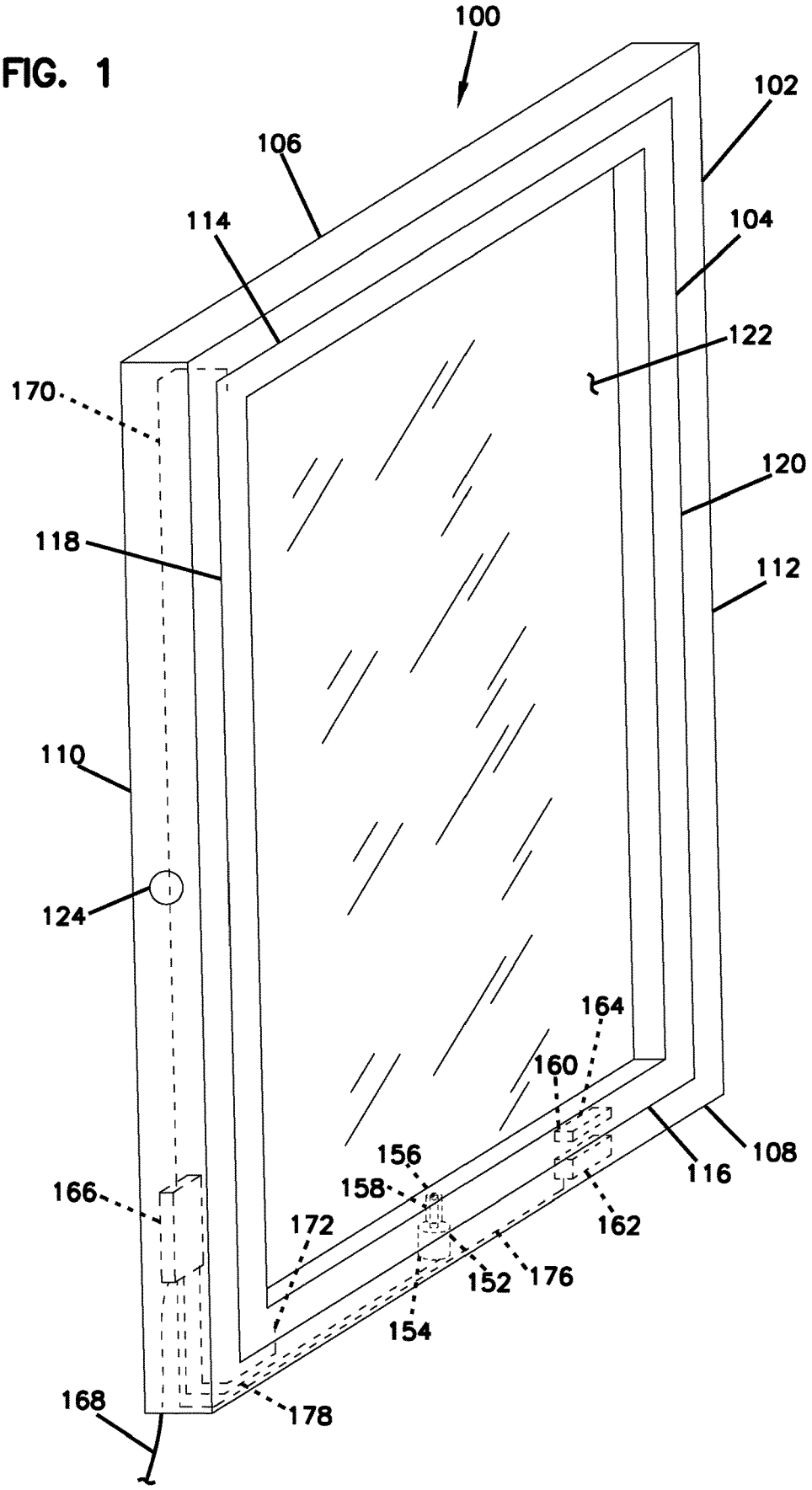
FIG. 1 is an isometric view of a window that can be operated with magnetic fields while the window is closed.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Whenever appropriate, terms used in the singular also will include the plural and vice versa. The use of "a" herein means "one or more" unless stated otherwise or where the use of "one or more" is clearly inappropriate. Use of the terms "or" and "and" means "and/or" unless stated otherwise or otherwise clear from the context of the related language. The use of "comprise," "comprises," "comprising," "include," "includes," "including," "has," and "having" are interchangeable and not intended to be limiting. The term "such as" also is not intended to be limiting. For example, the term "including" shall mean "including, but not limited to."

In general terms, this patent document related to a mechanism and method of automatically opening windows that have a pivoting sash. The windows are operated using electromagnets to generate electrical fields and controlling the polarity of those fields to open or close the sash. This document may interchangeable discuss opening and closing the window or opening and closing the sash. Both mean the same thing.

Referring now to FIGS. 1-4, a window 100 has a frame 102 and a sash 104 that pivots relative to the frame 102. In the illustrated embodiment, the sash 104 pivots on the side to form a horizontal pivoting window. The window 100 can have a closed position as illustrated in FIG. 1 and an open position illustrated in FIG. 2. The frame 102 has a head 106 extending along the top, a sill 108 extending along the bottom. First and second jams 110 and 112 are positioned on opposite sides of the frame 102 and extend between the head 106 and the sill 108. In various embodiments, the frame 102 can include additional components such as seals, casings, stools, cladding, and other components.

The sash 104 has upper and lower rails 114 and 116. First and second stiles 118 and 120 are positioned on opposite sides of the sash 104 and extend between the upper and lower rails 114 and 116. One or more panes of glass 122 are mounted in the sash 104. In various embodiments, the sash 104 can include sash bars or muttons, cladding, and other components. The frame 102 and the sash 104 can be made with any suitable material such as wood, aluminum and other metals, composites, and fiberglass.

First and second pivot hinges 124 and (not shown) are connected between the frame 102 and the sash 104 such that the first pivot hinge 124 is connected between the first jam 110 and the first stile 118, and the second pivot hinge (not shown) is connected between the second jam 112 and the second stile 120. In the illustrated embodiment, the first and second hinges 124 and (not shown) are mounted half way between the upper and lower rails 114 and 116 of the sash 104 so that the top and bottom portions of the sash 104 are equally weighted. Alternative embodiments of the window 100 also can include other components such as locks and keepers.

In alternative embodiments, however, the pivots hinges 124 and (not shown) can be mounted anywhere along the length of the stiles 118 and 120. For example, the pivot hinges 124 and (not shown) can be mounted toward the upper rail 114 to provide an awning window. In another example, the pivot hinges 124 and (not shown) can be mounted toward the bottom of the stiles 118 and 120 to provide a hopper window. In yet other alternative embodiments, the first and second pivot hinges 124 and (not shown) can be mounted between the head 106 and the upper rail 114 and between the sill 108 and the lower rail 116, respectively. In this alternative embodiment, the sash 104 pivots vertically and the window is a vertically pivoting casement window.

An upper screen 128 is connected between the frame 102 and the sash 104 above the first and second pivot hinges 124 and (not shown). The upper screen 128 has an upper portion 132 that extends between head 106 and upper rail 114, a first side portion 134 that extends between the first jam 110 and the first stile 118, and a second side portion (not shown) that extends between the second jam 112 and the second stile 120. The upper screen 128 is formed with strands of material that are woven into a fabric. Examples of materials that can be used include metal wire, fiberglass, and other composites. In at least some embodiments, described in more detail herein, the upper screen 128 can be woven with two or more materials in which at least one of the materials is an electrically conductive material, such as a metal wire, that can be used to form an electrical coil. The lower screen 130 is substantially similar to the upper screen 128 and has a lower portion 143, a first side portion 145, and a second side portion (not shown).

Figure 2:
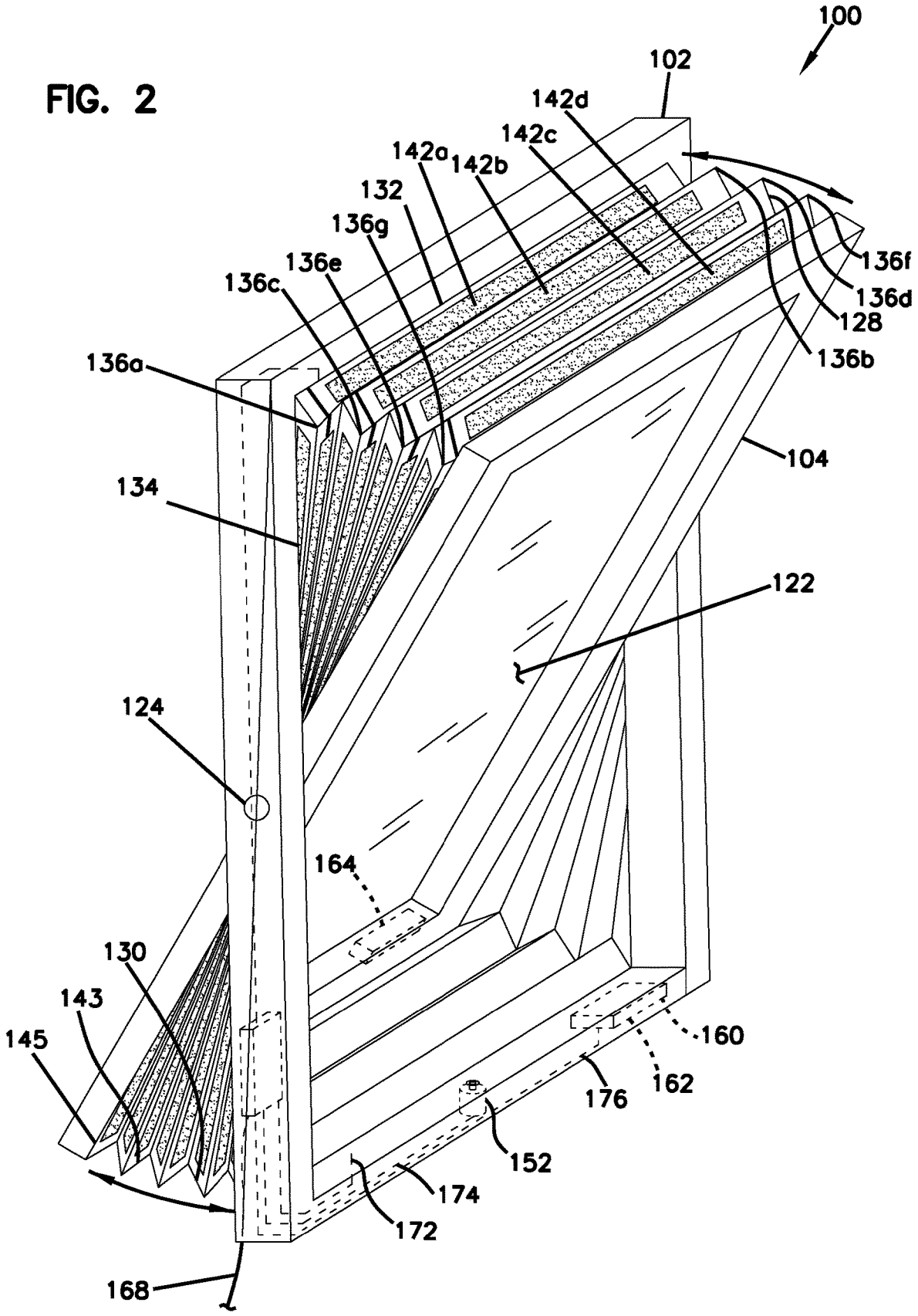
FIG. 2 is an isometric view of the window illustrated in FIG. 1 while the window is open.
Figure 3:
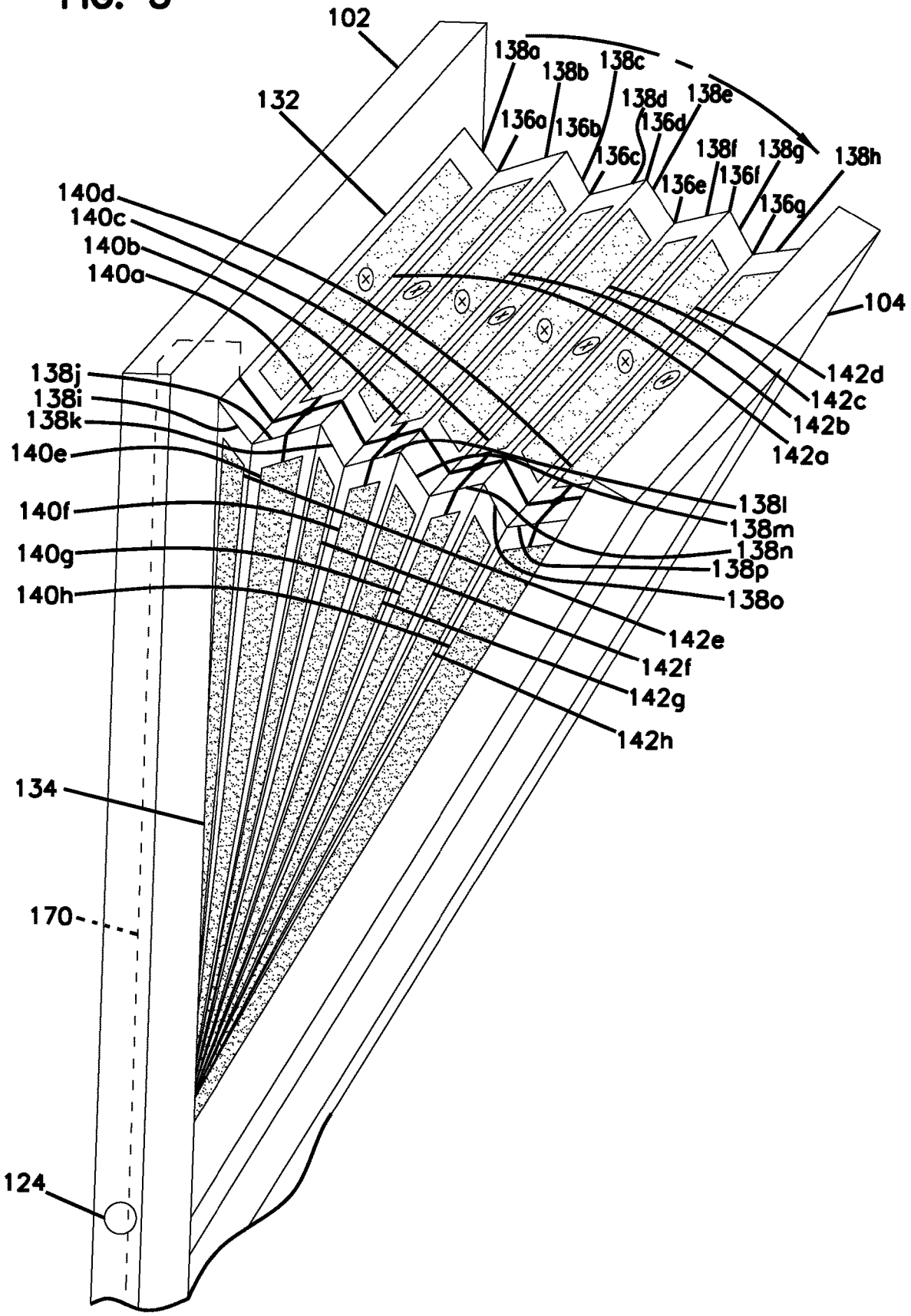
FIG. 3 is a partial, isometric view of the window illustrated in FIGS. 1 and 2 while the window is opening.

Referring now to FIGS. 2 and 3, the upper screen 128 has a plurality of accordion folds 136*a*-136*g* or pleats between the frame 102 and the sash 104. The accordion folds 136*a*-136*g* form a series of panels 138*a*-138*p* extending between the frame 102 and the sash 104. The members or panels 138*a*-138*p* alternate between facing the frame 102 (e.g., panels 138*b*, 138*d* . . . 138*p*) and facing the sash 104 (e.g., panels 138*a*, 138*c* . . . 138*o*) so that adjacent panels (e.g., panels 138*c* and 138*d*, and 138*d* and 138*e*) directly oppose or face each other. The number of panels and the depth of the panels can vary in alternative embodiments of the upper screen 128. When the sash 104 is in a closed position, the accordion folds 136*a*-136*g* are folded substantially flat so that adjacent panels (e.g., 138*d* and 138*e*) are substantially parallel and are positioned against each other or at least substantially close to each other. As the window 100 or sash 104 is moved to the open position, the angle between adjacent panels increases. The farther the sash 104 is open, the greater the angle between the panels 138*a*-138*p*.

Figure 4:
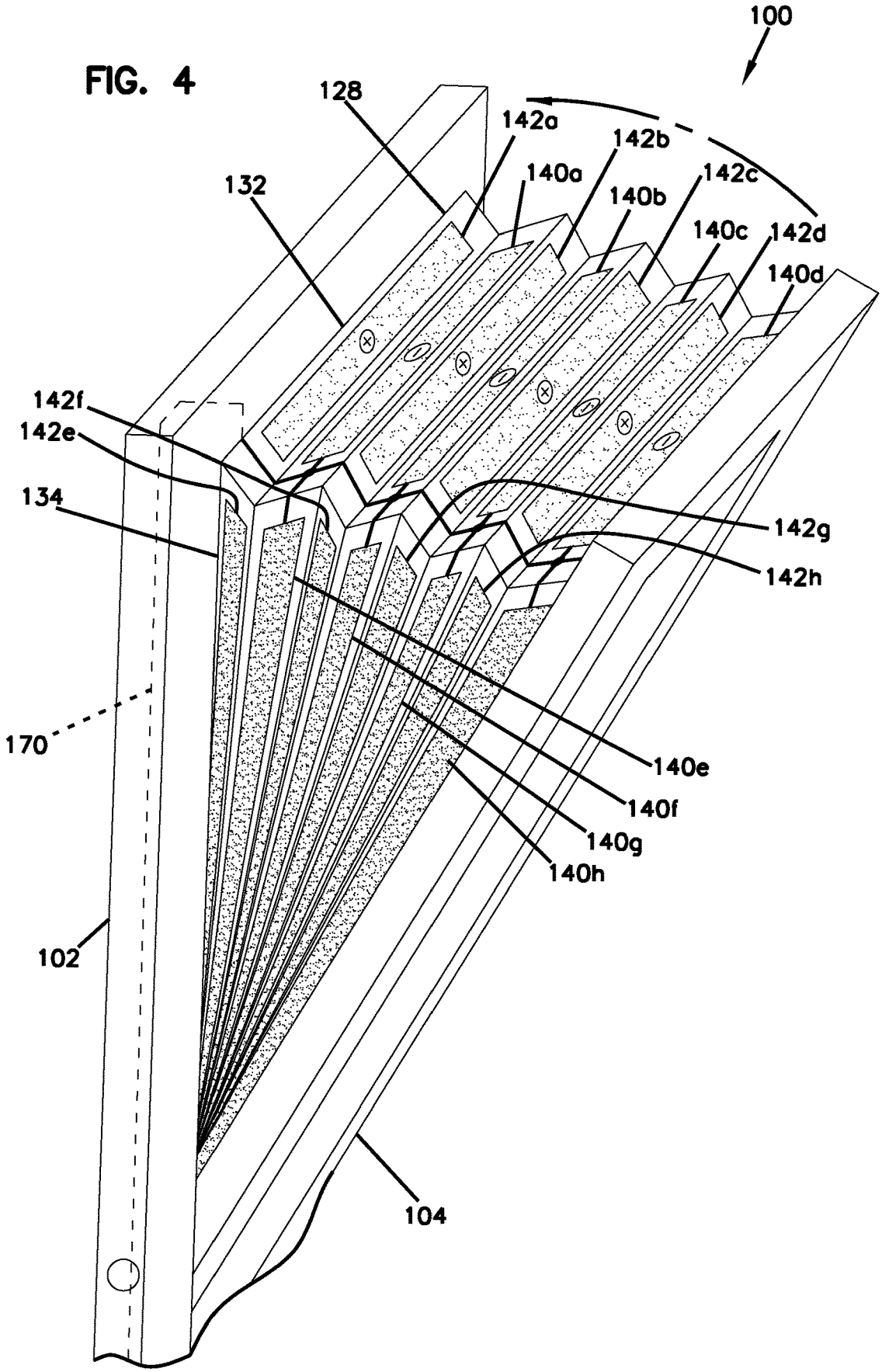
FIG. 4 is a partial, isometric view of the window illustrated in FIGS. 1 and 2 while the window is closing.

A plurality of electromagnets 140*a*-140*h* and permanent magnets 142*a*-142*h* are mounted on the upper screen 128. At least one electromagnet (e.g., 142*b*) is mounted on a panel (e.g., 138*d*), and at least one permanent magnet (e.g., 142*a* and 142*b*) is mounted on at least one adjacent panel (e.g., 138*c* and 138*e*) and directly opposes the at least one electromagnet (e.g., 142*b*). In this configuration, when the electromagnets 140*a*-140*h* are energized and have the same polarity as the permanent magnets 142*a*-142*h* as illustrated in FIG. 3 they will repel the permanent magnet 142*a*-142*h* thereby moving adjacent panels 138*a*-138*p* apart and pivoting the sash 104 away from the frame 102 to open the window 100. When the electromagnets 140*a*-140*h* are energized with a polarity opposite to the polarity of the permanent magnets 142*a*-142*h* as illustrated in FIG. 4 the opposite polarity they will attract the permanent magnets 142*a*-142*h* moving the adjacent panels 138*a*-138*p* closer together thereby pivoting the sash 104 toward the frame 102 and closing the window 100. Alternative embodiments can include members other than panels to support the magnets.

A set of magnets can include one or more electromagnets (e.g., 140*b*) on one panel (e.g., 138*d*) and one or more magnets, either permanent or electromagnets (e.g., 142*b*), on an adjacent panel (e.g., 138*c*). Alternatively, a set of magnets can include one or more electromagnets (e.g., 140*b*) on one panel (e.g., 138*d*) and one or more magnets, either permanent or electromagnet (142*b* or 142*c*), on panels (e.g., 138*c* or 138*e*) adjacent to either side of the one panel (e.g., 138*d*).

In alternative embodiments, the screen 128 can include a frame (not shown) to support the panels 138*a*-138*p* when the magnetic forces are moving the panels 138*a*-138*p* to either open or close the sash 104. An advantage of such a frame is that it will help hold the screen 128 taut as the magnetic forces are pushing or pulling the panels 138*a*-138*p* so that movement of the panels 138*a*-138*p* and movement of the sash 104 is more responsive to the magnetic fields. Having too much give in the screen 128 when a force is exerted against it will make movement of the sash 104 less responsive to the magnetic forces. An example of such a frame has elongated members along each of the accordion folds 136*a*-136*g* and cross members pivotally connected between adjacent elongated members. In these embodiments, the frame outlines each of the panels 138*a*-138*p*. Other embodiments that provide for a taut screen 128 are possible. For example, the screen 128 can be made with very stiff wire or fiber strands.

The electromagnets 140*a*-140*h* can be formed by relatively flat coils wrapped around an axis. In alternative embodiments, the coil can be wrapped around a core (not shown) formed with a ferromagnetic material. The core can be configured and positioned to help control and direct the magnetic field generated by the coils. The electromagnets 140*a*-140*h* can be attached directly to the screen 128 or mounted on a substrate that is in turn attached to the screen 128. In alternative embodiments, the electrically conductive wire forming the electromagnets 140*a*-140*h* can be used as the strands to form the screen 128 or to form at least a part of the screen 128 along the panels 138*a*-138*p*. In this embodiment, the wires of the coil are woven directly into the fabric of screen 128.

The permanent magnets 142*a*-142*h* can be substantially flat and mounted directly to the screen 128 or can be mounted to a substrate, which is in turn mounted directly to the screen 128. In an example embodiment, the electromagnets 140*a*-140*h* and permanent magnets 142*a*-142*h* are as flat as possible so that the accordion folds 136*a*-136*g* can be folded substantially flat when the window 100 is closed.

Additionally, each panel 138*a*-138*p* can have a single electromagnet or permanent magnet mounted on it as illustrated in the figures. In alternative embodiments, a plurality of electromagnets or permanent magnets can be mounted on the panels 138*a*-138*p*. In these embodiments, the magnets on a single panel 138*a*-138*p* can be spaced from each other to allow airflow through the screen 128. The panels 138*a*-138*p* are substantially flat. In alternative embodiments some or all of the panels 138*a*-138*p* can be curved or have a curved surface.

In yet other alternative embodiments, a second plurality of electromagnets can be used in place of the permanent magnets 142*a*-142*h*. When closing the sash 104 in these alternative embodiments, adjacent electromagnets are energized with electrical current flowing in opposite directions to provide electromagnets on adjacent panels with opposite polarities so the adjacent panels are attracted to each other. When opening the sash 104, adjacent electromagnets are energized with electrical current flowing in the same direction to provide electromagnets on adjacent panels with the same polarity so the adjacent panels are repelled from each other.

In an exemplary embodiment, the number and size of the panels are such that adjacent panels are at an angle to each other even when the sash 104 is pivoted as far as it can go and the window 100 is fully open. Having the adjacent panels at angles to each other when the sash 104 is fully open enables the electromagnets 140*a*-140*h* and permanent magnets 142*a*-142*h* to exert enough attractive force toward each other (when they have opposite polarities) to pull the panels together and pivot the sash 104 toward the closed position.

In an example embodiment as illustrated, sets of opposing magnets are mounted on panels that run along the upper portion 132 of the screen 128, along the first side 134 of the screen 128, and along the second side of the screen 128. Having magnets on all three sides of the screen 128 maximizes the total attractive and repulsive forces provided by the magnetic fields. Alternative embodiments can have opposing magnet sets along less than all three sides of the screen 128 so long as the magnetic forces between the sets of magnets 140*a*-140*h* and 142*a*-142*h* is strong enough to move the sash 104 along its entire range of motion—between a fully closed position and a fully open position. In other alternative embodiments, the magnets 140*a*-140*h* and 142*a*-142*h* are mounted on a structure other than a screen that holds the magnets 140*a*-140*h* and 142*a*-142*h* in a position that allows them to exert forces against each other through the sash's 104 entire range of motion.

Although the screen is illustrated as supporting the magnets 140*a*-140*h* and 142*a*-142*h*, alternative embodiments can include a structure other than a screen to support the magnets. For example, a series of members or panels can be used in place of the screen panels 138*a*-138*p* to support the magnets. Such members can be formed with fabric other than screening, solid panels, or similar structures that are able to move relative to each other along the path of movement for the sash. Additionally, the panels 138*a*-138*p* can be flexibility or rigid. The panels 138*a*-138*p* can be formed with either an inelastic or elastic material. Yet other embodiments include a frame structure having members that support the magnets and pivot or otherwise move relative to each other. A possible example is a scissor-type of frame.

The lower screen 130 is substantially similar to the upper screen 128 and includes a lower portion 143, a first side portion 145, and a second side portion (not shown). The lower screen 130 has a series of accordion folds that form panels. A series of electromagnet and permanent magnets are mounted on the panels similar to the electromagnets and permanent magnets mounted on the upper screen.

Figure 5:
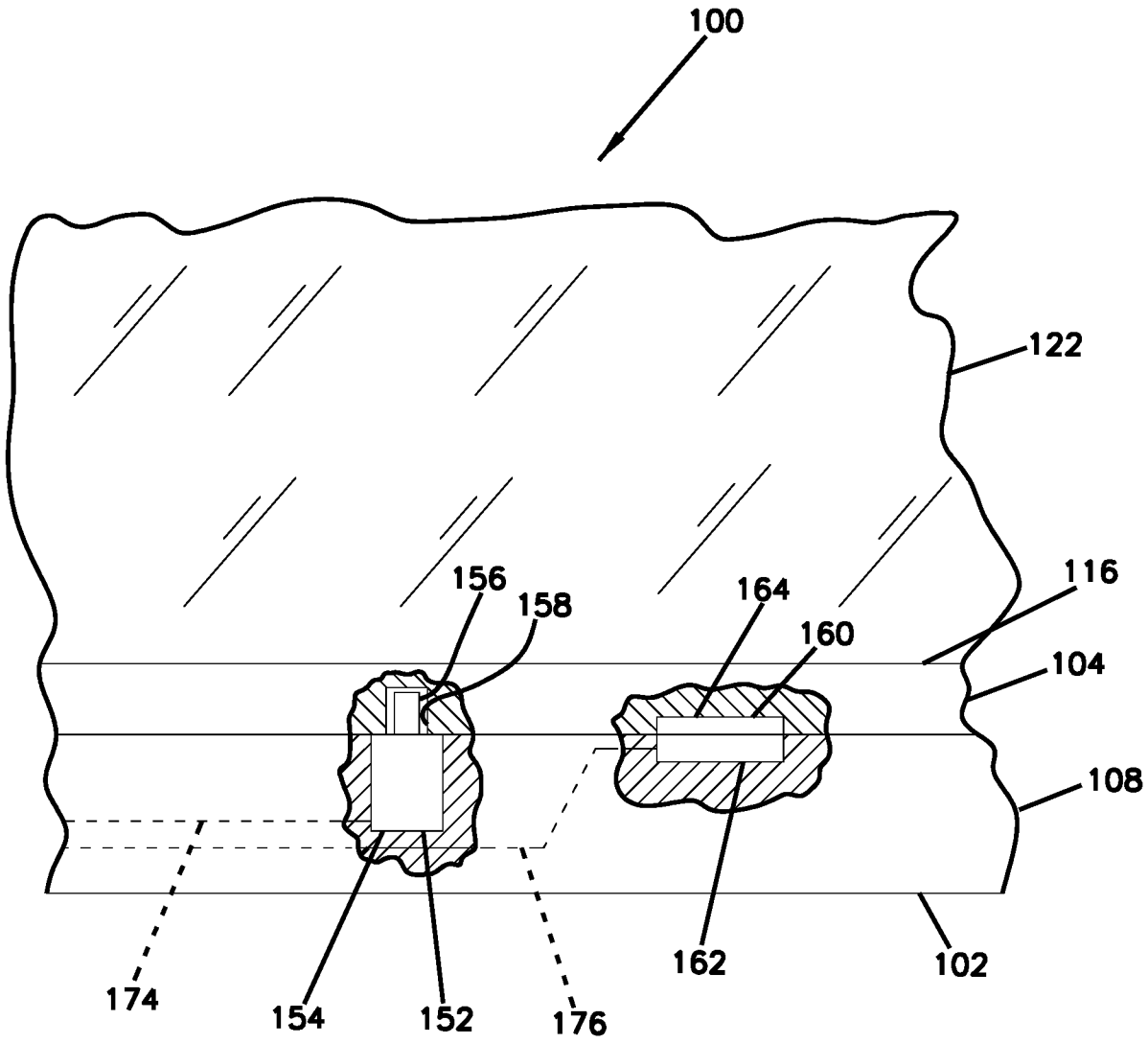
FIG. 5 is a partial top plan view of the window illustrated in FIG. 1 with cross sectional breakouts showing a solenoid and sensor

Referring now to FIGS. 1, 2, and 5, a linear electromechanical solenoid 152 has a body 154 with an electromagnetic coil wrapped around an axis and an armature 156 positioned along the axis and at least partially within the electromagnetic coil. The solenoid 152 has an engaged position in which the armature 156 is extended from the body 154 and an unengaged position in which the armature 156 is withdrawn into the body 154. The solenoid 152 is a latching solenoid so that the armature 156 maintains its set position (e.g., in the extended or engaged position, or retracted or unengaged position). An advantage of the latching solenoid is that it does not draw any energy when the armature 156 is in the engaged position or the unengaged position.

In the example embodiment, the solenoid 152 is mounted in the frame 102. The sash 104 defines a locking hole 158 that is sized to receive the armature 156. The locking hole 158 is open to the outer perimeter of the sash 104. When the window 100 is in a closed position, the locking hole 158 directly opposes the solenoid 152 and is aligned with the armature 156. In alternative embodiments, the solenoid 152 can be mounted external to the frame 102 and an external piece of hardware such as an eye or pad eye, can be mounted on the sash 104 and positioned to receive the armature 156 from the solenoid 152.

When in the sash 104 is in the closed position, the solenoid 152 is engaged so that the armature 156 is extended into the locking hole 158 and engaging the sash 104. This arrangement prevents the permanent magnets 142*a*-142*h* from repelling each other and opening the sash 104. When the window 100 is to be opened, the armature 156 of the solenoid 152 is actuated and the armature 156 is withdrawn from the locking hole 158 and into the solenoid body 154. The sash 104 is then free to pivot provided there is no other locking mechanism securing the sash 104 to the frame 102 and preventing it from pivoting.

Alternative embodiments can use a solenoid other than a linear electromechanical solenoid. Examples of other solenoids include a rotational solenoid, a pneumatic solenoid, or a hydraulic solenoid. Other embodiments can use manual or automated mechanisms other than a solenoid to hold the sash 104 in the closed position. Yet other embodiments do not use any mechanism other than the weight of the sash 104 to hold the sash 104 in the closed position.

A sensor 160 is mounted on the frame 102 and/or sash 104 to detect when the sash 104 is open or fully closed. The sensor 160 enables the controller 166, discussed herein, to determine when the sash 104 is closed and when to actuate the solenoid 152 to move the armature 156 into the engaged position. An example of such a sensor 160, as illustrated in the figures, is a reed switch 162 mounted in the frame 102 and a sensor magnet 164 mounted in the sash 104. In this embodiment, the sensor magnet 164 is positioned directly opposing the reed switch 162 when the sash 104 is in the closed position. In this embodiment, the sensor magnet 164 throws the reed switch 162 into one state when the sash 104 is moved into the closed position. The reed switch 162 is then moved into the opposite state when the sash 104 is opened and the sensor magnet 164 is moved away from the reed switch 162. Depending on how the controller 166 is configured, the reed switch 162 can be a normally open or normally closed switch. Alternative embodiments can use sensors other than a reed switch such as capacitive sensors, photoelectric sensors, inductive sensors, and ultrasonic sensors. Angular positon sensors such as optical or magnetic encoders also can be used. Such angular position sensors would be axially aligned with the pivot hinges 124 and (not shown). Yet, other embodiments do not use any sensor and rely on the user to determine when the solenoid 152 should be actuated.

A controller 166 is also embedded in the frame 102 and is electrically connected to the electromagnets 140*a*-140*h* on the upper screen 128 and lower screen 130 with electrical conductors 170 and 172, respectively. The controller 166 has a switching mechanism that controls the flow of electrical current through the electromagnets 140*a*-140*h*. In an example embodiment, the controller 166 is switchable between an on/opening state, an on/closing state, and an off state. When in the on/opening state, the controller 166 delivers an electrical current through the electromagnets 140*a*-140*h* in one direction to generate a magnetic field having the same polarity as the permanent magnets 142*a*-142*h*. When in the on/closing state, the controller 166 delivers an electrical current through the electromagnets 140*a*-140*h* in an opposite direction so that the electromagnets 140*a*-140*h* have a polarity opposite to the polarity of the permanent magnets 142*a*-142*h*. In the off state, the controller 166 is electrically disconnected from the electromagnets 140*a*-140*h* so that the electromagnets 140*a*-140*h* do not generate any magnetic fields and do not attract or repel the sash 104 to open or close it. The controller 166 can be switched to the off state when the window 100 is closed or when the sash 104 is open and in a desired rotational position. In alternative embodiments, the controller 166 is programmed or otherwise wired to automatically transition from the on/closing state to the off state after the solenoid 152 is actuated and the armature 156 enters the locking hole 158.

The controller 166 also is electrically connected to the solenoid 152 and sensor 160 by conductors 174 and 176, respectively, and controls operation of the solenoid 152 to move the armature 156 between the engaged and unengaged positions. In operation, when the sash 104 is moved into the closed position, the solenoid 152 would be actuated and the armature 156 moved from the unengaged position to the engaged position so that the solenoid armature 156 would move into the locking hole 158 and secure the sash 104 in the closed position. When the controller 166 is changed to the on/opening state, the controller 166 actuates the solenoid 152 to withdraw the solenoid armature 156 from the locking hole 158 and entirely within the frame 102. The sash 104 can then pivot past the solenoid 152 and open. When the controller 166 is in the off state, the controller 166 does not deliver any electrical current to the solenoid 152.

In an example embodiment, the controller 166 is wired to a 120/220 Volt alternating current power source 168 such as the building electrical wiring. The controller 166 can then include a transformer to step down the voltage; a rectifier to convert the alternating current to a direct current; discrete electrical components to filter and condition the electrical signals and current delivered to the electromagnets **140*a*-140*h*, solenoid 152, sensor 160, and other components of the controller 166; a first set of switches arranged to switch the direction of the electrical current delivered to the electromagnets 140*a*-140*h* or to electrically disconnect the electromagnets 140*a*-140*h* from the controller 166; a second set of switches arranged to switch the direction of the electrical current delivered to the solenoid 152 or to electrically disconnect the solenoid 152 from the controller 166; and a programmable circuit programmed and arranged to receive input from the sensor 160, switches, or other control elements. Additionally, the controller 166 can include a wireless interface to control the window 100** through a wireless interface. The wireless interface can use any type of suitable wireless standard such as Bluetooth™ or any of the IEEE 802.11 wireless standards. A wireless interface can enable control of the window through remote devices such as home automation systems; applications on smart phones, tablet computers, and other computers; and dedicated remote control units.

In alternative embodiments, the controller 166 can include manual actuators that a user can throw to control the flow of electrical current to the electromagnets **140*a*-140*h* and solenoid 152. In yet other alternative embodiments, the controller 166 can include adjustable electrical components such a potentiometers or other adjustable electrical components to control the amplitude of the electrical current delivered to the electromagnets 140*a*-140*h*. An advantage of these embodiments is the rate at which the sash 104 pivots can be adjusted. These embodiments also enable the controller 166 to be calibrated to provide enough force to pivot the sash 104 into the fully closed position. Alternative embodiments also might include batteries, either rechargeable or disposable, as the main power source in place of the 120/220 Volt alternating current power supply 168. In these battery-operated embodiments, the controller 166** may not require a transformer or rectifier.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The invention claimed is:

1. An apparatus for moving a window sash relative to a window frame, the apparatus comprising:

a window comprising a window frame and a window sash pivotally connected to the window frame;

a plurality of members positioned between the window sash and the window frame, the plurality of members arranged in a series;

a plurality of magnet sets, each magnet set comprising at least a first magnet operably connected to one member in the series of members and at least a second magnet operably connected to another member in the series of members, the first magnet being adjacent the second magnet, at least one of the first or second magnets being an electromagnet; and wherein, upon being energized, the electromagnet is configured to move the members in the series of members relative to each other and cause the window sash to move relative to the window frame.

2. The apparatus of claim 1, wherein the window sash is pivotally connected to the window frame.

3. The apparatus of claim 2, wherein the window is selected from the group consisting of: awning window, hopper window, casement window, horizontal-pivot window, and vertical pivot window.

4. The apparatus of claim 2, wherein:

the window sash has two oppositely disposed end portions and a middle portion between the two oppositely disposed end portions; and the window sash is pivotally connected to the window frame at the middle portion.

5. The apparatus of claim 2, wherein:

the window sash has two oppositely disposed end portions and a middle portion between the two oppositely disposed end portions; and the window sash is pivotally connected to the window frame at one of the end portions.

6. The apparatus of claim 1, wherein the one member and the another member are configured to pivot relative to each other.

7. The apparatus of claim 6, wherein the one member and the another member comprise screening.

8. The apparatus of claim 6, further comprising:

a screen operably connected between the window frame and the window sash, the screen comprising:

a plurality of accordion folds between the window frame and the window sash, each accordion fold comprising alternating raised and recessed folds, each fold separating portions of the screen into at least one screen member; and the first magnet in each magnet set operably connected to the screen on one side of an accordion fold and the second magnet in each magnet set operably connected to the screen on an opposite side of the accordion fold.

9. The apparatus of claim 2, wherein each of the first and second magnets is an electromagnet.

10. The apparatus of claim 2, wherein the first magnet is an electromagnet and the second magnet is a permanent magnet.

11. The apparatus of claim 1, further comprising:

a sensor arranged to detect when the window sash is in a fully closed position;

a solenoid, the solenoid comprising an armature, the solenoid arranged so the armature selectively extends between the window frame and the window sash; and a controller electrically connected to the sensor and the solenoid, the controller configured to determine when the window sash is fully closed and to actuate the solenoid and move the armature to a position engaging both the window frame and the window sash upon detecting the window sash is fully closed.

* * * * *